US008905233B2

(12) United States Patent
Glass et al.

(10) Patent No.: US 8,905,233 B2
(45) Date of Patent: Dec. 9, 2014

(54) GIFT CARD HOLDER FOR CONFORMING TO AN ARTICLE SUSPENDED THEREFROM

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 5 days.

(21) Appl. No.: 13/595,055

(22) Filed: Aug. 27, 2012

(65) Prior Publication Data

US 2013/0228491 A1 Sep. 5, 2013

Related U.S. Application Data

(60) Provisional application No. 61/527,905, filed on Aug. 26, 2011.

(51) Int. Cl.
*B65D 73/00* (2006.01)
*B65D 85/00* (2006.01)

(52) U.S. Cl.
CPC ..... *B65D 85/00* (2013.01); *B65D 73/0007* (2013.01); *B65D 73/0071* (2013.01); *Y10S 206/806* (2013.01)
USPC ..... 206/461; 206/806; 206/460

(58) Field of Classification Search
USPC ..... 206/461, 232, 464, 831, 349, 806.46; 40/299.01; 248/317
See application file for complete search history.

(56) References Cited

U.S. PATENT DOCUMENTS

| | | | | |
|---|---|---|---|---|
| 3,945,559 | A * | 3/1976 | Krautsack | 229/100 |
| 6,382,676 | B1 * | 5/2002 | Cochran et al. | 283/51 |
| 7,607,574 | B2 * | 10/2009 | Kingsborough et al. | 235/380 |
| 2003/0052243 | A1 * | 3/2003 | Kolton et al. | 248/214 |
| 2010/0011634 | A1 * | 1/2010 | Dweck et al. | 40/124.06 |

* cited by examiner

*Primary Examiner* — David Fidei
(74) *Attorney, Agent, or Firm* — Polsinelli PC

(57) ABSTRACT

An assembly for holding a transaction card, such as a gift card, upon an articulated, multi-panel structure that conforms to the shape of an underlying substrate, such as a box or other container.

4 Claims, 2 Drawing Sheets

GIFT CARD HOLDER FOR CONFORMING TO AN ARTICLE SUSPENDED THEREFROM

CROSS REFERENCE TO RELATED APPLICATIONS

This application claims the benefit of the prior filed, provisional application, Ser. No. 61/527,905, filed Aug. 26, 2011, incorporated by reference herein.

BACKGROUND OF THE INVENTION

This invention relates generally to gift card holders and more particularly to an assembly for holding a gift card as well as an article, such as a box or other container, with the assembly taking no more display space than typically allotted for a gift card mounted on a backer.

Transaction cards, stored value cards, or gift cards, as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or, more commonly, is selected at the point of sale by the purchaser and loaded by the cashier using a magnetic card reader/writer.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, individual gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

What is needed, therefore, is a device capable of holding multiple gift card holders and associated gift cards in a single packet within the allotted display space, thereby increasing the value relative to price for the purchaser and increasing the value and price relative to space for the merchant displaying and selling embodiments thereof.

BRIEF DESCRIPTION OF THE INVENTION

An embodiment of the present invention includes an assembly comprising a gift card holder attached to and conforming to the shape of an underlying substrate. The assembly enables a transaction card, such as a gift card, to be displayed with an item such as a box or other container while taking no more display space than typically allotted for a single gift card mounted on a backer.

The gift card holder includes a header for hanging the assembly upon a display rack. The header includes a vertically upright planar panel with a generally centrally located aperture for receiving a display rack peg. The header may comprise two subpanels that are typically adhered together.

The subpanels may be formed from a single panel of card stock or similar material that is folded over to form a double thickness header panel. A substrate attachment panel extends downward from a lower margin of the header to contact a first, generally vertical face of a substrate, such as a container. In certain embodiments, the container comprises a box having square or rectangular faces attached to one another at approximately ninety degree angles. Adhesive or other operable means attaches the attachment panel to the first vertical substrate face.

In certain embodiments, a tongue extends horizontally from a lower margin of the header to overlie a generally horizontal face of the substrate. A card attachment tab extends downward from the outer portion of the tongue, namely the edge of the tongue distal to the lower margin of the header, to overlie and typically contact a second, generally vertical face of the substrate. An outer surface of the card attachment tab bears removable adhesive or other means for attaching a transaction card to the tab.

An embodiment of the invention may also include a substrate having a rear vertical face, a front vertical face, and a horizontal face extending therebetween and joining the top edge of the rear vertical face to the top edge of the front vertical face. A header panel is attached to the rear vertical face and projects upward above the horizontal face a sufficient distance to contain an aperture sized to receive a display rack peg. A tongue extends forward from the header panel to overlie the horizontal face, the proximate portion of the tongue being hingedly connected to a lower margin of the header and the distal portion of the tongue extending downward to overlie the front vertical face of the substrate. A transaction card is removably attached to this distal portion of the tongue.

Another embodiment of a transaction card holder assembly may include a substantially vertically disposed header panel and a substantially vertically disposed substrate attachment panel extending downward from a lower margin of the header panel to lie against a first, rearward facing, substantially vertical face of a substrate, such as a box or other container. A substantially horizontally disposed tongue extends forward from the lower margin of the header panel to overlie an upper, substantially horizontal face of the substrate. A card attachment tab or panel extends downward from a forward margin of the tongue (also distal to the header) to lie against a second substantially vertical face of the substrate. The card attachment panel includes means for removeably attaching a transaction card to its outer, substantially vertical face. Such means may include removeable adhesive or one or more slits for receiving portions (typically corners) of a transaction card, or other operable means including means known in the prior art. This embodiment thereby provides a transaction card holder assembly for holding a transaction card, such as a gift card, upon an articulated, multi-panel holder structure that conforms to the shape of an underlying substrate, such as a box or other container.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
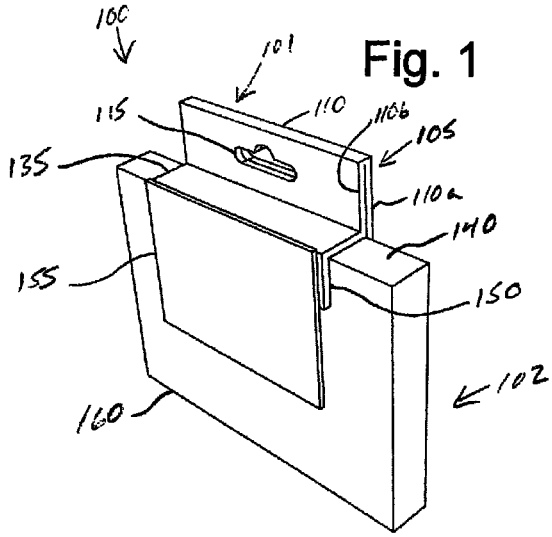
FIG. 1 is a front, right perspective view of a gift card holder assembly showing a container attached to and suspended from a gift card holder.
Figure 2:
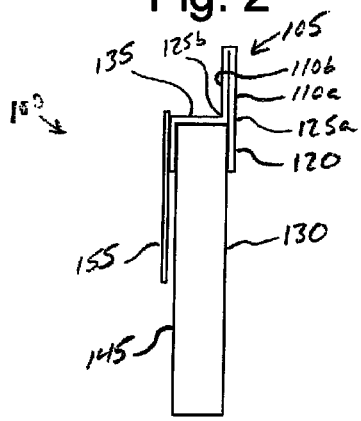
FIG. 2 is a right elevation view of the assembly.
Figure 3:
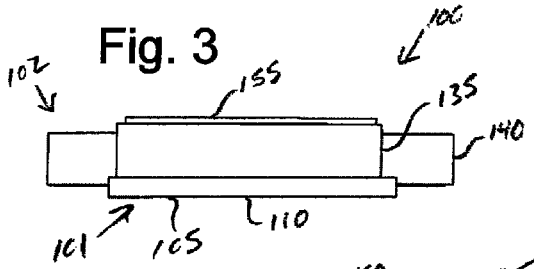
FIG. 3 is a top plan view of the assembly.
Figure 4:
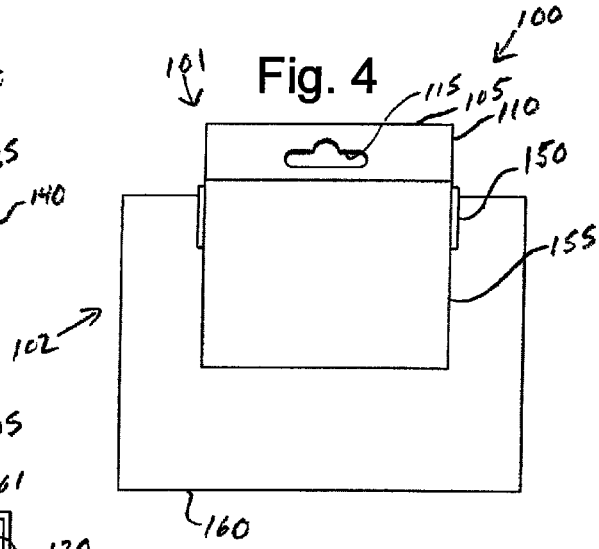
FIG. 4 is a front elevation view of the assembly.
Figure 5:
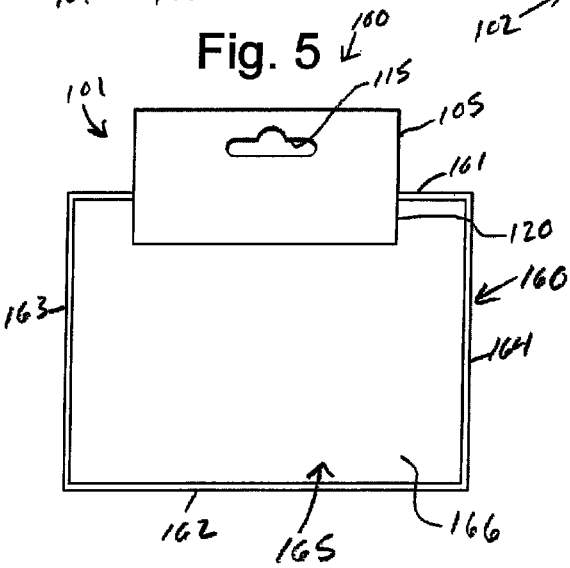
FIG. 5 is a rear elevation view of the assembly.
Figure 6:
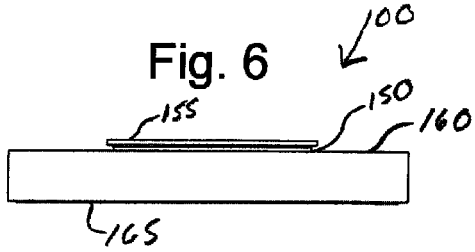
FIG. 6 is a bottom plan view of the assembly.
Figure 7:
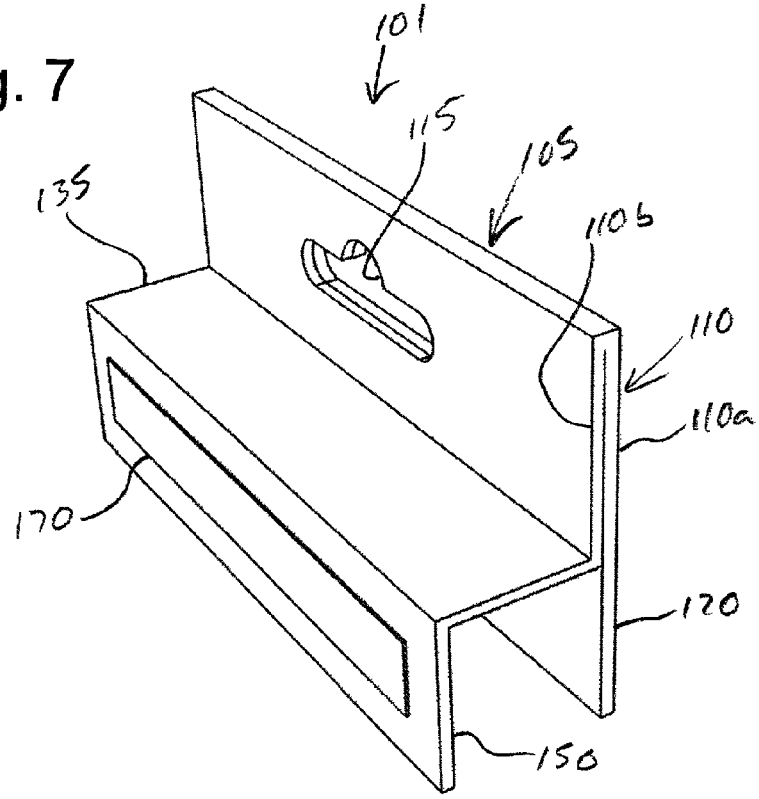
FIG. 7 is a front, top, right perspective view of the gift card holder.
Figure 8:
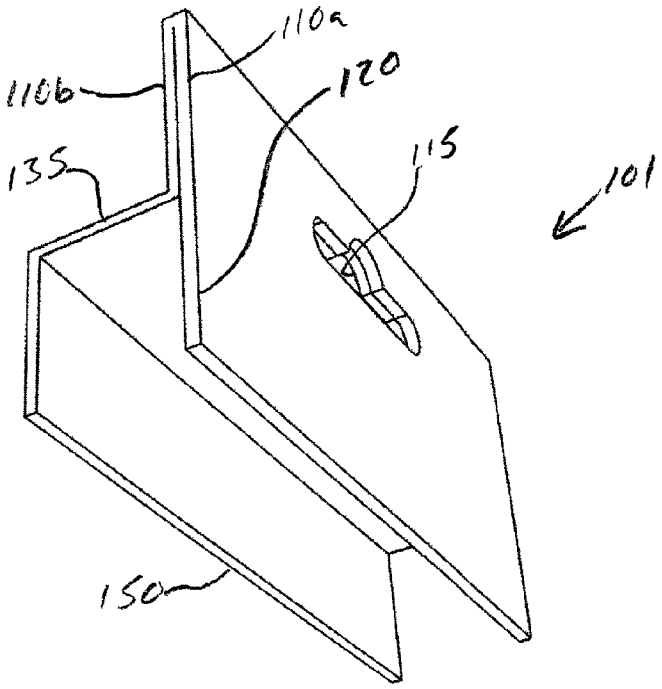
FIG. 8 is a rear, bottom right perspective view of the gift card holder.

With reference to the figures, FIGS. 1 through 6 are illustrations of various embodiments of an assembly 100 comprising a gift card holder 101 attached to and conforming to the shape of a substrate, such as a container 102. The gift card holder 101 (also shown separately in FIGS. 7 and 8) includes a header 105 for hanging the assembly 100 upon a display rack (not shown). The header 105 is formed from a vertically upright planar panel 110 having an aperture 115 therein for receiving a display rack peg (not shown). The header may comprise two subpanels 110*a* and 110*b* that are typically adhered together. The subpanels 110*a* and 110*b* may be formed from a single panel of card stock or similar material that is folded over to form a double thickness header panel 110.

A substrate attachment panel 120 extends downward from a first lower margin 125*a* of the header 105 to contact a first, generally vertical face 130 of the substrate 102. The substrate 102 may comprise an article such as a container, and may comprise an article associated with gift giving, such as a gift box. Adhesive, or equivalent operable means, applied between the attachment panel 120 and the upper portion of the first vertical substrate face 130 attaches the attachment panel 120 to the first vertical substrate face 130.

A tongue 135 extends horizontally from a second lower margin 125*b* of the header 105 to overlie a generally horizontal face 140 of the substrate 102. The tongue 135 may be an extension of a header subpanel, for example the forward subpanel 110*b* shown in the figures, or may be formed separately and attached to the header 105. Typically, the tongue 135 is formed by folding a portion of the subpanel 110*b* extending beyond the lower margin 125*b* to a horizontal position relative to a vertically positioned header 105. The proximate portion of the tongue 135 is thereby hingedly connected to the lower margin 125*b* of the header so that the tongue 135 may pivot about the hinged connection to rest upon the horizontal face 140. The distal portion of the tongue 135 extends downward to form a card attachment tab 150 that overlies a second, generally vertical face 145 of the substrate 102. A transaction card 155 is removably attached to an outer surface of the card attachment tab 150. The outer surface of the card attachment tab 150 bears removable adhesive 170 or other means for attaching a transaction card to the tab.

As shown in FIGS. 1-6, an embodiment of the assembly 100 may include a substrate comprising a conventional gift box 102. The box 102 comprises an outer lid portion 160 and an inner tray portion 165 sized to slide and fit inside the lid 160 so that the rearward (as illustrated) edges 161-164 of the lid 160 are relatively flush with the rear panel 166 of the tray 165 (see FIG. 5). In this embodiment, the substrate attachment panel 120 of the header 105 attaches to the box 102 at or near the upper margin of the rear panel 166. By attaching to the rear panel 166, bridging the top surface (horizontal face 140) of the box 102, and wrapping around the top surface 140 to overlie the front surface (second vertical face 145) of the box 102, the gift card holder 101 forms a clamping mechanism that clamps the lid 160 and tray 165 together in a closed position by holding the lid 160 and tray 165 between the card attachment tab 150 and the substrate attachment panel 120.

Elements of the gift card holder 101 and substrate 102 may comprise card board, heavy paper, card stock or the like, including plastic.

Having thus described the invention, what is claimed as new and desired to be secured by Letters Patent is:

1. A transaction card holder comprising:

a substantially vertically disposed header panel;

a substantially vertically disposed substrate attachment panel extending downward from a lower margin of said header panel;

a substantially horizontally disposed tongue extending forward from said lower margin of said header panel;

a card attachment panel extending downward from a forward margin of said tongue distal to said header;

a substrate, where a first vertical face of the substrate is contacted with an interior attachment surface of the substantially vertically disposed substrate attachment panel and where a second vertical face of the substrate is contacted with an interior surface of the card attachment panel; and an attachment surface for attaching a transaction card to a forward facing, substantially vertical face of said card attachment panel.

2. The holder of claim 1, wherein the attachment surface comprises adhesive.

3. The holder of claim 1, wherein the attachment surface comprises one or more slits within said card attachment panel sized and disposed to receive one or more corners of a transaction card.

4. A transaction card holder assembly comprising:

a substantially vertically disposed header panel;

a substantially vertically disposed substrate attachment panel extending downward from a lower margin of said header panel to lie against a first substantially vertical face of a substrate;

a substantially horizontally disposed tongue extending forward from said lower margin of said header panel to overlie an upper, substantially horizontal face of said substrate;

a card attachment panel extending downward from a margin of said tongue distal to said header to lie against a second substantially vertical face of said substrate;

an attachment surface for removeably attaching a transaction card to an outer, substantially vertical face of said card attachment panel; and where the transaction card holder assembly conforms to the shape of an underlying container, having a lid and a tray, where the substrate attachment panel and the card attachment panel hold the lid and tray together in a closed configuration.

* * * * *